US011885502B2

(12) United States Patent
Barth et al.

(10) Patent No.: US 11,885,502 B2
(45) Date of Patent: Jan. 30, 2024

(54) DOOR FOR A COOKING DEVICE COMPRISING A SEPARATE FRAME WITH A RECESSED GRIP, AND COOKING DEVICE COMPRISING A DOOR

(71) Applicant: BSH Hausgeräte GmbH, Munich (DE)

(72) Inventors: Veronika Barth, Munich (DE); Charlotte Bick, Munich (DE); Frank Rieser, Gröbenzell (DE)

(73) Assignee: BSH Hausgeräte GmbH, Munich (DE)

( * ) Notice: Subject to any disclaimer, the term of this patent is extended or adjusted under 35 U.S.C. 154(b) by 373 days.

(21) Appl. No.: 17/269,271

(22) PCT Filed: Jun. 13, 2019

(86) PCT No.: PCT/EP2019/065485
§ 371 (c)(1),
(2) Date: Feb. 18, 2021

(87) PCT Pub. No.: WO2020/038623
PCT Pub. Date: Feb. 27, 2020

(65) Prior Publication Data

US 2021/0239324 A1 Aug. 5, 2021

(30) Foreign Application Priority Data

Aug. 22, 2019 (DE) ..... 10 2018 214 143.6

(51) Int. Cl.
*F24C 15/04* (2006.01)
*F24C 15/00* (2006.01)
*F24C 15/02* (2006.01)

(52) U.S. Cl.
CPC ..... *F24C 15/04* (2013.01); *F24C 15/008* (2013.01); *F24C 15/024* (2013.01)

(58) Field of Classification Search
CPC ..... F24C 15/04; F24C 15/024
See application file for complete search history.

(56) References Cited

U.S. PATENT DOCUMENTS 3,889,099 A 6/1975 Nuss
2006/0191225 A1 8/2006 Bienick et al.
(Continued)

FOREIGN PATENT DOCUMENTS

DE 3827528 A1 8/1989
DE 102009026959 A1 12/2010
(Continued)

OTHER PUBLICATIONS

National Search Report DE20190416 dated Apr. 12, 2019.
International Search Report PCT/EP2019/065485 dated Nov. 7, 2019.

*Primary Examiner* — Jason Lau
(74) *Attorney, Agent, or Firm* — Michael E. Tschupp; Andre Pallapies; Brandon G. Braun

(57) ABSTRACT

A door for a cooking appliance includes a front pane, a further pane arranged in spaced-apart relation to the front pane, a recessed grip embodied in an upper region of the door and configured for gripping from above, and a separate functional frame arranged in an intermediate space between the front pane and the further pane when viewed in a depth direction of the door. The functional frame includes an upper frame part having a delimiting web which protrudes upward on the upper frame part such that the recessed grip is embodied in the upper frame part.

18 Claims, 6 Drawing Sheets

(56) References Cited

U.S. PATENT DOCUMENTS

| | | | |
|---|---|---|---|
| 2009/0255524 | A1 | 10/2009 | Marco et al. |
| 2010/0101555 | A1 | 4/2010 | Hiroki et al. |

FOREIGN PATENT DOCUMENTS

| | | | | |
|---|---|---|---|---|
| DE | 102010041022 | A1 | 3/2012 | |
| EP | 0277923 | A2 | 8/1988 | |
| EP | 1308676 | A2 | 5/2003 | |
| GB | 2013872 | A | 8/1979 | |
| JP | S52118157 | U | 9/1977 | |
| JP | 2012042119 | A | 3/2012 | |
| WO | WO-2005073635 | A1 * | 8/2005 | ..... F24C 15/006 |
| WO | 2015062920 | A1 | 5/2015 | |

* cited by examiner

DOOR FOR A COOKING DEVICE COMPRISING A SEPARATE FRAME WITH A RECESSED GRIP, AND COOKING DEVICE COMPRISING A DOOR

CROSS-REFERENCES TO RELATED APPLICATIONS

This application is the U.S. National Stage of International Application No. PCT/EP2019/065485, filed Jun. 13, 2019, which designated the United States and has been published as International Publication No. WO 2020/038623 A1 and which claims the priority of German Patent Application, Serial No. 10 2018 214 143.6, filed Aug. 22, 2018, pursuant to 35 U.S.C. 119(a)-(d).

BACKGROUND OF THE INVENTION

One aspect of the invention relates to a door for a cooking appliance. The door has a front pane and a further pane arranged such that it is spaced apart therefrom. The door further has a recessed grip, which is embodied in the upper region of the door and which can be gripped from the top. A further aspect of the invention relates to a cooking appliance comprising such a door.

Doors for cooking appliances are known in a wide variety of embodiments. They usually have a pane pack comprising at least two separate panes, which are arranged in parallel with and spaced apart from one another. These plate-shaped panes are usually glass panes.

Such a door is known for example from DE 10 2010 041 022 A1. There, the door has four separate panes. The inner pane is designed there as a one-piece, trough-shaped part in which two intermediate panes are received. A front pane of this pane pack is arranged on a trough flange of this trough-shaped inner pane on the front side. When viewed in the height direction, this front pane is embodied with greater dimensions than the inner pane and the intermediate panes. When viewed in the height direction, the front pane therefore projects beyond the other panes in an upward direction. A handle element is thereby formed behind the front pane in the pane point itself. However, the door there has no further components other than the pane pack. The panes are thus held accordingly only by the trough-shaped inner pane itself.

Furthermore, a door for a cooking appliance is known from DE 10 2009 026 959 A1. Provision is made there for a door body having a glass plate as its front pane. A separate handle tray is incorporated in an upper region of this door body, which handle tray is open toward the top and can be gripped from the top.

Furthermore, the door can also have a light element. A frame is arranged separately from the door and thus externally to the door on a housing of the cooking appliance, on which the door is then arranged in a pivotable manner. In the closed state of the door, the door is surrounded by this frame, which is fixed on the housing side.

BRIEF SUMMARY OF THE INVENTION

An object of the present invention is to create a door for a cooking appliance which can be structured more variably in terms of being equipped with individual components and, in this regard, then also to enhance the functionality of the door. Accordingly, it is also an object of the invention to create a household appliance with such a door.

One aspect of the invention relates to a door for a cooking appliance. The door has a front pane. The door also has a further pane which is separate from the front side and arranged such that it is spaced apart therefrom. The door also has a recessed grip, which is embodied in the upper region of the door. The recessed grip can be gripped from the top. When viewed in the depth direction of the door, a separate functional frame of the door is arranged in an intermediate space between the front pane and the further pane. The functional frame has a delimiting web which protrudes upward on an upper frame part such that the recessed grip is embodied in the upper frame part. The recessed grip is delimited by the delimiting web on the front side. According to such an embodiment, a door with an increased number of separate components is provided. These components enable the door to be structured variably and flexibly. In particular, the functional assignment of functions of the door to individual components is thereby enabled in an individual and improved manner. In particular, the handle in its specific embodiment as a recessed grip is thus incorporated into the frame part which is separate from the panes. The specific position of this frame part, namely between the front pane and the further pane in a connection direction between these two panes, then also enables the additional function that the functional frame can be used as a spacing element for the two panes. By the recessed grip likewise being embodied in a specific manner, namely by a delimiting web drawn upward on the front side, which is in particular integrated into the frame part and thus embodied in one piece therewith, it is once again possible in this context to achieve a compact embodiment with a reduced number of components in this regard. In this context, the front pane is then provided without a functional contribution to the geometric design of the recessed grip. An undesired smearing or a significant manifestation of fingerprints or the like on this front pane can thereby be avoided. Undesired impact or other wear on the front pane, in particular on the upper edge, can also thereby be avoided, since the front pane no longer effectively forms the direct and no longer covered delimitation of the recessed grip in this context, as is the case in the prior art. Any chipping of edges of this front pane can also thereby be avoided.

In this context, the separate functional frame with this upper frame part also represents a more robust and, in this regard, more stable component.

It is preferably provided that the delimiting web is embodied protruding upward and projecting freely in an upward direction on a region of the upper frame part facing toward the front pane. The recessed grip is thereby also provided with corresponding depth and it is made possible in a simple and user-friendly manner to grip behind the frame part. The functionality of the recessed grip is highly advantageous in this context. Furthermore, according to such an embodiment, the delimiting web can also be designed in a highly filigreed and nevertheless mechanically stable manner, so that here on the one hand weight can be saved and on the other hand the recessed grip is not undesirably restricted when viewed in the depth direction of the door.

It is preferably provided that the delimiting web is embodied protruding upward with an oblique orientation facing away from the further pane such that the recessed grip is embodied to widen out toward a recessed grip opening. A recessed grip is thereby provided which can be gripped particularly easily in the upper region and has a correspondingly greater width here. An undesired complicated and only very narrow gripping with fingers of one hand is thereby avoided. An undesired impact of fingers on an only very narrow recessed grip can thereby also be avoided, as the recessed grip is also correspondingly enlarged by this widening. In particular, it is also achieved by way of this embodiment that, on account of this obliquely oriented protrusion, a kind of roof pitch or an overhang projecting forward on the front side is formed in comparison to the front pane, so that an additional protection of the front pane, in particular in the upper edge area, is enabled by such an orientation of the delimiting web.

It is preferably provided that the recessed grip is delimited directly on the rear side, and thus on the side facing toward the further pane when viewed in the depth direction, by a front side of the further pane. As a result, the further pane is also used in a multifunctional manner, as it also represents a delimiting wall of the recessed grip. The shape complexity of the frame part can thereby be reduced, as an additional delimiting wall for the recessed grip, which would then be formed by the upper frame part itself, is not required. An embodiment of this type can however also be provided.

It is advantageously provided that an in particular strip-like fascia panel separate therefrom is arranged on an upper edge of the front pane and covers the delimiting web on the front side at least in regions. The separate fascia panel is in particular also a separate component from the delimiting web. By way of such an embodiment, a covering of the delimiting web on the front side can be achieved such that an individual optical overall impression of the front side can also be produced here, which is then influenced by the fascia panel. In particular, individual optical variants can then be formed in this context while nevertheless enabling a uniform, identical part to be used with regard to the functional frame. Furthermore, this separate fascia panel also forms a highly individual edge protection for the upper edge or the upper side of the front pane. In this context, it can be provided that only this separate fascia panel covers the upper edge of the front pane and that the functional frame, in particular the delimiting web, is arranged such that it is spaced apart from the front pane, in particular from the upper edge of the front pane. Especially if the functional frame is embodied from metal, for example, it is thus possible to avoid undesired impairments of the front pane, for example scratching or the like. Furthermore, such an embodiment with a separate fascia panel enables a certain apex to be achieved for this delimiting web, which can then be embodied to be particularly filigreed. In particular, a delimiting wall of the recessed grip is then formed on the front side by the delimiting web and the fascia panel, which is likewise oriented in an upward direction in this regard. As a result, a very substantial subcomponent of the recessed grip, namely this front recessed grip part, is also designed in a more stable and robust manner. By gripping around or behind and in this context also normally gripping this delimiting web with the fascia panel which is then preferably provided, an improved force absorption is then also enabled such that, when the door is pulled forward and thus a force exerted on the delimiting web and the fascia panel, a higher mechanical stability is achieved. An undesired deformation or yielding of the delimiting web can thereby be avoided.

It is advantageously provided that the fascia panel rests directly on the delimiting web. The above-mentioned advantages are thereby achieved to a particular degree. In particular, an adhesive bonding can in addition be embodied between the delimiting web and the fascia panel. Undesired position changes or relative movements between these two components can thereby be avoided in an even more improved manner.

It is preferably provided that an upper edge of the further pane, when viewed in the height direction of the door, is arranged higher than an upper edge of the front pane. In particular, this upper edge of the further pane is arranged higher than an upper edge of the delimiting web. The front pane is thereby embodied as a relatively large plate, as a result of which on the one hand the delimitation of the recessed grip on the rear side is advantageously provided extensively and adequately. Specifically by such an embodiment of a large further pane, the possibility is then also created that this further pane is a front pane of a pane pack of the door. In one advantageous embodiment, this pane pack then does not have this front pane, but instead has separate further panes in addition to the further pane, in particular at least one further additional pane, which when viewed in the depth direction is mounted to the rear and is thus arranged on the opposite side of the front pane from the further pane. As a result, a conventional pane pack of a door can also be formed with the further pane, which then serves as the front pane of the pane pack, and said additional panes, at least one further intermediate pane and an inner pane. In this context, said pane pack then also fulfills the conventional functions regarding on the one hand reducing the thermal energy loss from a cooking compartment of a cooking appliance and on the other hand preventing the front pane from heating up in an undesired manner. To this end, in particular corresponding ventilation mechanisms are also provided in the pane pack, as is the case in conventional pane packs for conventional doors. Precisely in such an embodiment comprising a pane pack specified in this connection, the front pane and the functional frame are then effectively an additional front attachment module on the front pane of the pane pack. Compared to conventional embodiments of a door comprising such a pane pack, this attachment which is attached accordingly onto the front pane toward the front can be regarded as an add-on module which enables and delivers the abovementioned additional functions. In this embodiment, the recessed grip is thus disposed not behind but instead in front of the front pane of such a pane pack. The front side of the front pane delimits the recessed grip to the rear. The recessed grip thus protrudes out of the pane pack toward the front.

It can also be provided that, in a further embodiment, the front pane contributes functionally at least in a supporting manner to the functions of such a pane pack and thus can form part of a pane pack which is then innovative and supplemented in this regard.

It is preferably provided that a frame which is separate from the panes and from the separate functional frame is arranged in an intermediate space between the front pane and the further pane, which frame has a funnel-shaped connecting member when viewed in the depth direction of the door. In such an embodiment, there are then effectively two separate frames, namely the functional frame on the one hand and this additional frame on the other hand. Both are then arranged in particular in this intermediate space between the front pane and the further pane.

Viewed generally, the arrangement of the functional frame in the intermediate space should be understood accordingly to mean that the functional frame extends at least partially into the volume space which is actually delimited only between the two panes, namely the front pane and the further pane. When viewed in a vertical section through the door, the functional frame is thus arranged such that it at least partially overlaps both the front pane and also the further pane.

The same can be said in particular of the further frame. In particular, this further frame is arranged in its entirety within this intermediate space.

On account of the funnel-shaped connecting member of the separate frame, the latter has a subcomponent which enables individual optical aspects associated specifically with this geometric embodiment. When viewed from the front side, the funnel shape which then converges to the rear in the depth direction produces an optical depth effect of a light pattern, which also enables a certain specific three-dimensionality of the door lighting. Furthermore, this funnel-shaped connecting member delimits a very specific receiving space or volume space, wherein this volume space is then formed effectively in the shape of a truncated pyramid. This funnel-shaped connecting member effectively produces a kind of optical fascia panel, which creates the impression that the actual window opening is displaced further toward the rear so that a corresponding view through the door is made possible, with a very specific optical viewing effect nevertheless being achieved on account of the funnel-shaped connecting member.

It is advantageously provided that the door has at least one light element, with which light can be radiated onto the additional separate frame such that the light is or can be radiated onto the oblique walls of the funnel-shaped connecting member facing toward the front pane. This is a particularly advantageous embodiment, as it enables highly individual lighting scenarios in the door interior. A particularly advantageous aspect of the active connection between the funnel-shaped connecting member and this generated light is that a highly specific frame-like light effect or a light pattern is thus produced, enabling a highly spatial embodiment of the light image on account of the funnel-shaped connecting member. Because this light image can then also be perceived and viewed through the front pane when the door is viewed from the front, since the front pane is transparent at least in this section in which the funnel-shaped connecting member is arranged, the advantages specified above can be enabled. In particular, a light frame can be produced here as a light pattern.

It is preferably provided that the light element is a light guide. As a result, the light from a light source can be guided in a very targeted manner into specific regions and radiated in a highly individual manner. In particular, this enables light to be radiated in a very defined manner onto the oblique walls forming or delimiting the funnel-shaped connecting member. As a result, the specific light pattern or light image described above can be generated in a particularly advantageous and homogeneous manner.

In particular, the light guide is embodied to be rod-shaped. As a result, a very extensive and even and thus homogeneous radiation of light into a larger region of the connecting member, in particular onto an entire oblique wall of such a connecting member, can be enabled.

In particular, it is provided that the light element is arranged in a channel-like receptacle of the frame. As a result, a more mechanically stable seating of the light element can be achieved. In particular, it is thereby also enabled that the light element can be disposed in the immediate vicinity of and thus in particular directly adjacent to an oblique wall of the funnel-shaped connecting member. This accordingly enables the light from the light guide to be radiated directly and via a short path onto an oblique wall of the funnel-shaped connecting member. This enables the light pattern to be generated evenly and the loss of radiated light to be kept to a minimum.

In particular, the channel-like receptacle is open toward the front pane and the bottom of the channel thus faces toward the further pane. According to this embodiment, the light guide is in particular also exposed on the side facing toward the front pane.

As a result, it is possible, depending on requirements, also to enable an individual radiation directly onto the front pane in this regard. This can take place individually, in particular as a function of the design of the light guide.

It is preferably provided that the receptacle is open toward the front pane and surrounds the funnel-shaped connecting member circumferentially at least in regions. By the funnel-shaped connecting member being surrounded in this way in an essentially frame-like manner by this receptacle, one or more light guides can be arranged on various sides of this funnel-shaped connecting member. In particular, the funnel shape is an angular funnel shape, which is embodied as a truncated pyramid shape. In this context, the roof of this truncated pyramid shape is embodied as a hole or aperture. In particular, this funnel-shaped connecting member is thus formed such that the oblique walls represent the lateral walls of such a truncated pyramid. The truncated pyramid base and the truncated pyramid roof are not present in this context, so that the connecting member effectively forms only the lateral walls of such a truncated pyramid.

The further separate frame is preferably embodied in one piece. It can be embodied in particular from sheet metal, and it can be provided in particular that the individual parts are produced by stamping and/or reforming, such as bending or the like. In particular, this then also applies to the receptacle for the light element.

The light element advantageously has a bulge-shaped light radiation region when viewed in a cross-section at right angles to the longitudinal axis of the light element, which light radiation region is arranged facing toward the funnel-shaped connecting member and/or has a notch as a prism structure on the side facing toward the front pane. As a result, light can particularly advantageously be radiated in a defined manner directly onto an oblique wall. In particular, an individual further radiation in the direction of the front pane can thus take place directly.

It is preferably provided that, in a corner region of the frame, a support element separate therefrom is arranged for a light source, with which light from the light source can be coupled into the light element which in particular rests directly thereon. A light source can be for example a light-emitting diode or a light-emitting diode assembly. In particular, a heat sink for this light source is also arranged in this corner region. As a result, the light source can have a compact structure and can be positioned as required in the door. In this context, a light guide can then in particular be embodied in one piece and in a homogeneous manner as a rod extending over the entire length of an oblique wall of the funnel-shaped connecting member. As well as enabling the light from the light source to be coupled simply and extensively into this light guide, this also enables the light from the light guide to be radiated in a particularly homogeneous and even manner over the entire length of the oblique wall.

It is preferably provided that the further pane is a front pane of a pane pack of the door, wherein the front pane and the functional frame are attached as a front module attachment to a front side of the front pane. The advantages which can be achieved in this regard have already been set out above.

A further independent aspect of the invention relates to a door for a cooking appliance. The door has a front pane and a further pane arranged such that it is spaced apart therefrom. A frame which is separate from the panes is arranged in an intermediate space between the front pane and the further pane. In a cross-sectional representation of the door, this means that the frame extends at least in regions into the intermediate space and in particular is arranged in its entirety therein. In this cross-sectional representation, the frame is thus arranged such that it overlaps the panes when viewed in a direction parallel to the two planes. The frame has a funnel-shaped connecting member, wherein the door has at least one light element, with which light can be radiated onto the frame such that the light is or can be radiated directly onto the oblique walls of the funnel-shaped connecting member which face toward the front pane. The oblique walls are embodied such that the funnel shape of the connecting member delimits a truncated pyramid shape. In this context, the oblique walls form the lateral wall of this truncated pyramid shape.

Embodiments of the aforementioned first independent aspect of a door are to be regarded as advantageous embodiments of the aforementioned further independent aspect with regard to the door.

A further aspect of the invention relates to a cooking appliance having a door in accordance with an aforementioned aspect.

The cooking appliance has in particular a housing, in which a cooking compartment is embodied. This is delimited in particular by walls of a muffle. The door is preferably arranged in a movable manner on the housing and arranged on the housing to close the cooking compartment on the front side.

The cooking appliance can be for example an oven or a steam cooking appliance or a microwave cooking appliance. Particularly in the case of a microwave cooking appliance, the door can then also be a microwave door and be constructed accordingly in this regard. In such an embodiment, too, a front module attachment as already described in examples above can then be arranged on the front side of the front pane.

The designations "above", "below", "in front", "behind", "horizontal", "vertical", "depth direction", "width direction", "height direction", etc. indicate positions and orientations during proper use and arrangement of the appliance.

Further features of the invention are disclosed in the claims, the figures and the description of the figures. The features and combinations of features mentioned in the description above and the features and combinations of features set out below in the description of the figures and/or shown in the figures alone are usable not only in the respective combination given, but also in other combinations or alone without departing from the scope of the invention. Embodiments of the invention which are not explicitly shown in the figures and described, but which arise and can be created through separate combinations of features from the embodiments described, are therefore also to be considered as included and disclosed. Embodiments and combinations of features can also be regarded as disclosed which therefore do not have all the features of an originally formulated independent claim.

BRIEF DESCRIPTION OF THE DRAWINGS

Exemplary embodiments of the invention will now be described in greater detail making reference to schematic drawings, in which.

DETAILED DESCRIPTION OF EXEMPLARY EMBODIMENTS OF THE PRESENT INVENTION

Figure 1:
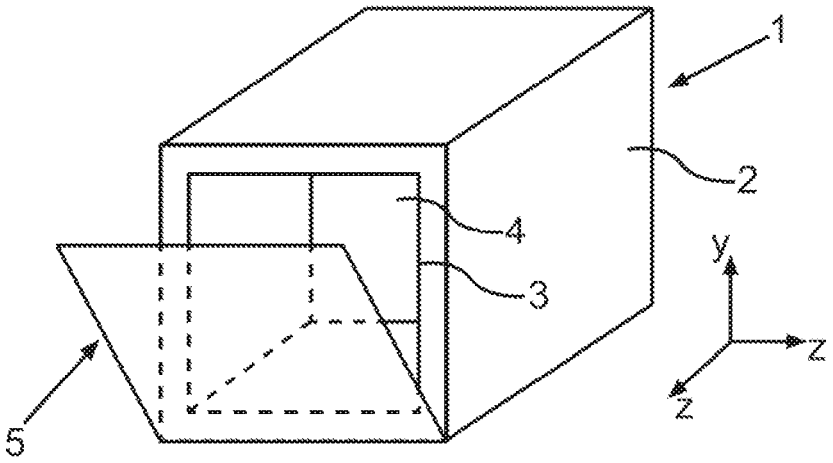
FIG. 1 shows a schematic representation of an exemplary embodiment of a cooking appliance according to the invention.

In the figures, the same or functionally identical elements are provided with the same reference characters.

FIG. 1 shows a schematic representation of a cooking appliance 1. The cooking appliance 1 has a housing 2, in which a muffle 3 is arranged. With its walls, the muffle 3 delimits a cooking compartment 4. The cooking appliance 1 also has a door 5 which is arranged in a movable manner on the housing 2 and is embodied to close the cooking compartment 4 on the front side.

Figure 2:
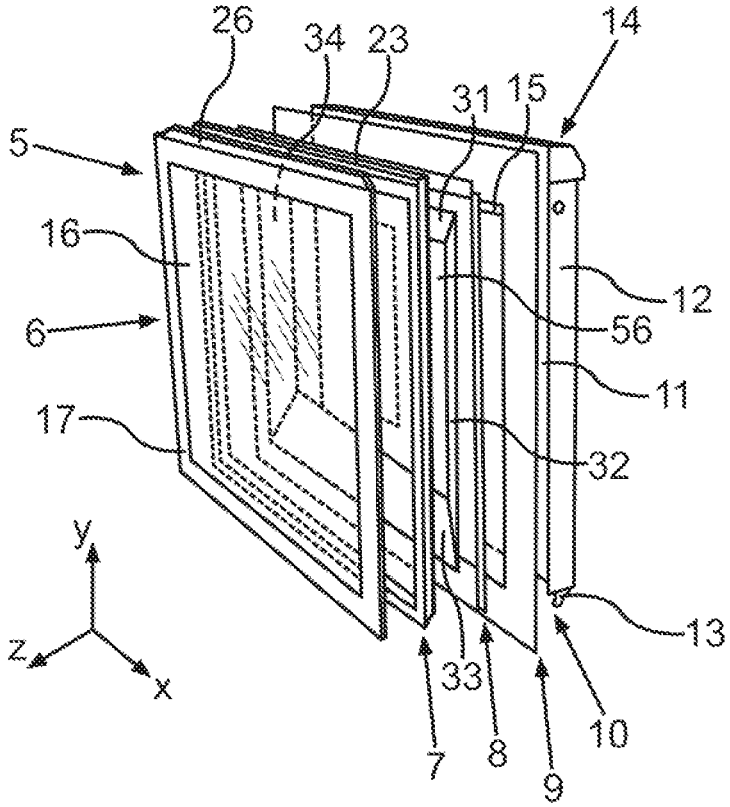
FIG. 2 shows an exploded representation of an exemplary embodiment of a door according to the invention.

FIG. 2 shows the door 5 in an exploded view in an exemplary embodiment. The door 5 has a front pane 6 when viewed in the depth direction (z direction). The front pane 6 is a plate which can be embodied in particular at least in regions from glass. Furthermore, the door 5 has a functional frame 7 which is separate from the front pane 6. The functional frame 7 is embodied fully circumferentially. In addition, the exemplary embodiment in FIG. 2 has a further frame 8 which is separate from the functional frame 7. This frame 8 is likewise preferably embodied to be circumferentially closed. Moreover, a further pane 9 is embodied adjacently to the rear in the depth direction. This is in particular embodied such that it is spaced apart from and parallel to the front pane 6. In the exemplary embodiment, the further pane 9 in particular represents a front pane of a pane pack 10. In addition to this further pane 9, the pane pack 10 has at least one more further pane, which is arranged adjacently to the rear of and spaced apart from the further pane 9 when viewed in the depth direction. The pane pack 10 can however also have more than two, for example three or four, panes. These additional panes of the pane pack 10 are arranged on the side of the further pane 9 which lies opposite the front pane 6. As can furthermore be seen in FIG. 2, door profiles 12, of which only one of the two door profiles 12 can be seen in FIG. 2, are arranged on a rear side 11 of this further pane 9 which faces away from the front pane 6. The door profiles 12 are preferably pole-shaped or rod-shaped elements which extend in the height direction (y direction). The additional panes of the pane pack 10 are held on these door profiles 12. Furthermore, the door 5 is also embodied by corresponding coupling elements 13, which are arranged in particular on the door profiles 12, for the movable connection to the housing 2. An upper, strip-like fascia panel 14 is also provided, which covers the pane pack 10 from above. This fascia panel is likewise arranged on the side of the further pane 9 which faces away from the front pane 6.

This top cover in the form of this fascia panel 14 in particular also has openings or slits to enable a ventilation of the pane pack 10.

In particular, a module attachment is formed by the front pane 6, the functional frame 7 and the frame 8 separate therefrom, which module attachment is arranged on a front side 15 of the further pane 9. This further pane 9 here in particular represents a front pane of the pane pack 10. The module attachment is thus arranged adjacently around the pane pack 10 on the front side.

As can also be seen in FIG. 2, the front pane 6 has a clear-view window 16, through which the interior can be viewed. At least this region is thus embodied to be transparent. Furthermore, a surround 17 is embodied on this front pane 6, for example by a coating, which on the one hand delimits this clear-view window 16 and on the other hand is preferably opaque. Partial regions of the components arranged therebehind, in particular of the functional frame 7 and of the further frame 8, can be covered thereby toward the front.

Figure 3:
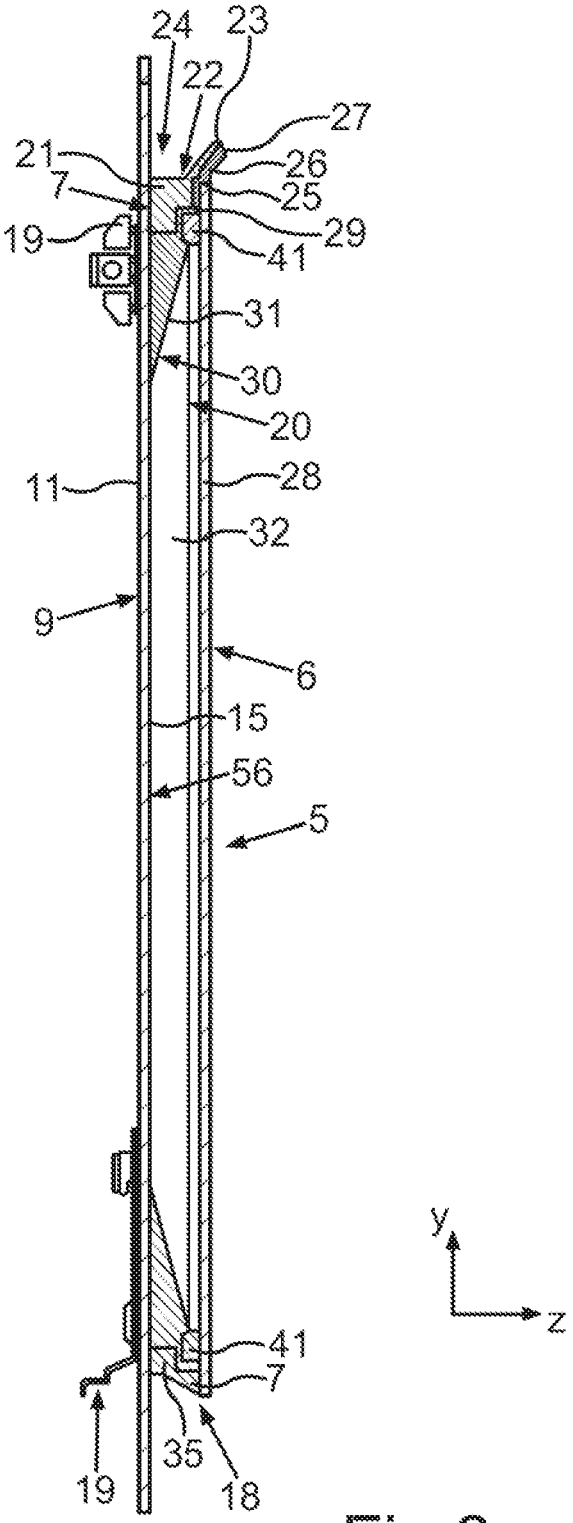
FIG. 3 shows a vertical sectional representation through an exemplary embodiment of subcomponents of a door.

FIG. 3 shows a vertical sectional representation (sectional plane is the y-z plane) of subcomponents of the door 5 in FIG. 2. As can be seen in this assembled state, said module attachment 18 is mounted directly on the front side 15 of this further pane 19. FIG. 3 shows only this further pane 9 of the pane pack 10. As can be seen, holding elements, in particular in the form of adhesive brackets 19, are shown on the rear side 11 of this further pane 9, which are arranged on this rear side 11 and are provided for fastening the door profiles 12.

As can also be seen in FIG. 3, the further pane 9 has greater dimensions than the front pane 6. In particular when viewed in the height direction, the further pane 9 extends further upward and downward compared to the front pane 6.

As can be seen in FIG. 3, the functional frame 7 is mounted, for example glued, directly onto the front side 15 of the further pane 9. In this vertical sectional representation, the functional frame 7 extends at least in regions into an intermediate space 20, which is formed between the front pane 6 and the further pane 9. This means that, in this vertical sectional representation, the functional frame 7 when viewed in this height direction is arranged at least in regions such that it overlaps the front pane 6 as well as the further pane 9. Furthermore, it can be seen that the functional frame 7 has an upper frame part 21 in which a recessed grip 22 is embodied in an integrated manner. To this end, the upper frame part 21 has a delimiting web 23 which protrudes upward. This delimiting web 23 projects freely in an upward direction from a front end of this frame part 21 which faces toward the front pane 6. In particular, this delimiting web 23, as shown in FIG. 3, is embodied with an oblique orientation. The oblique orientation is designed here such that it is oriented away from the further pane 9 starting from the upper frame part 21 or from a base body of this upper frame part 21. As a result, a recessed grip opening 24 of the recessed grip 22 is widened in an upward direction so as to facilitate an improved grip. The delimiting web 23 projects in an upward direction beyond an upper edge 25 of the front pane 6. In this vertical sectional representation, the delimiting web 23 also overlaps this upper edge 25 in the depth direction (z direction). In the embodiment shown in FIG. 3, it is provided that the functional frame 7 is arranged such that it is spaced apart from the front pane 6.

It is provided that the door 5 has a fascia panel 26 which is separate from the functional frame 7 and also from the further frame 8. This fascia panel 26 is arranged, in particular directly, on the upper edge 25 of the front pane 6. It fully covers the upper edge 25 from above. This fascia panel 26 likewise has a subregion 27 which projects upward and is arranged with an oblique orientation which corresponds to the oblique orientation of the delimiting web 23. When viewed in the depth direction, this subregion 27 projects forward in relation to the front pane 6, in particular the upper edge 25. A corresponding collar is thereby formed.

The fascia panel 26 extends beyond this and partially behind the front pane 6, and rests on a rear side 28 of the front pane 6. Furthermore, it is provided in particular that this fascia panel 26 and the functional frame 7 rest directly on one another.

In the exemplary embodiment shown, the recessed grip 22 is delimited on the rear side by the further pane 9. The front side 15 thus forms a direct delimiting wall of the recessed grip 22. When viewed in the depth direction, the recessed grip 22 is thus arranged in front of the further pane 9 and in particular also outside and in front of the pane pack 10.

Furthermore, FIG. 3 also shows the position and arrangement of the further frame 8. This further frame 8 is smaller than the functional frame 7 and is surrounded circumferentially thereby. In particular, it is connected directly to the functional frame 7. A precisely fitting interconnection in this regard is provided in particular on a pedestal or a stepped contact region 29.

As already shown in FIG. 2 and as can be seen in the sectional representation in FIG. 3, this further frame 8 has a funnel-shaped connecting member 30 when viewed in the depth direction. In the exemplary embodiment, this funnel-shaped connecting member 30 has four walls 31, 32, 33, 34 (FIG. 2) which are adjacent to one another. The four oblique walls 31 to 34 adjoining one another are oriented and arranged with respect to one another such that they effectively delimit the volume of a truncated pyramid on the lateral wall. The oblique walls 31 to 34 thus form the lateral wall of such a truncated pyramid.

As can be seen here, this funnel shape is oriented such that the oblique walls 31 to 34 widen out in a forward direction from the further pane 9 to the front pane 6.

As can be seen here, in the exemplary embodiment the further frame 8 rests both on the front side 15 of the further pane 9 and also on the rear side 28 of the front pane 6. In particular, the further frame 8 can thus also be regarded as a spacing element in the intermediate space 20 between the front pane 6 and the further pane 9. In particular, in the exemplary embodiment the functional frame 7 likewise represents a spacing element between the front pane 6 and the further pane 9, especially in active connection with the fascia panel 26 in the upper region. In the lower region, as can be seen in FIG. 3, the functional frame 7 is connected directly to the front pane 6 and the further pane 9 and then therefore represents a corresponding spacing element in the lower region with respect to a lower frame part 35.

Figure 4:
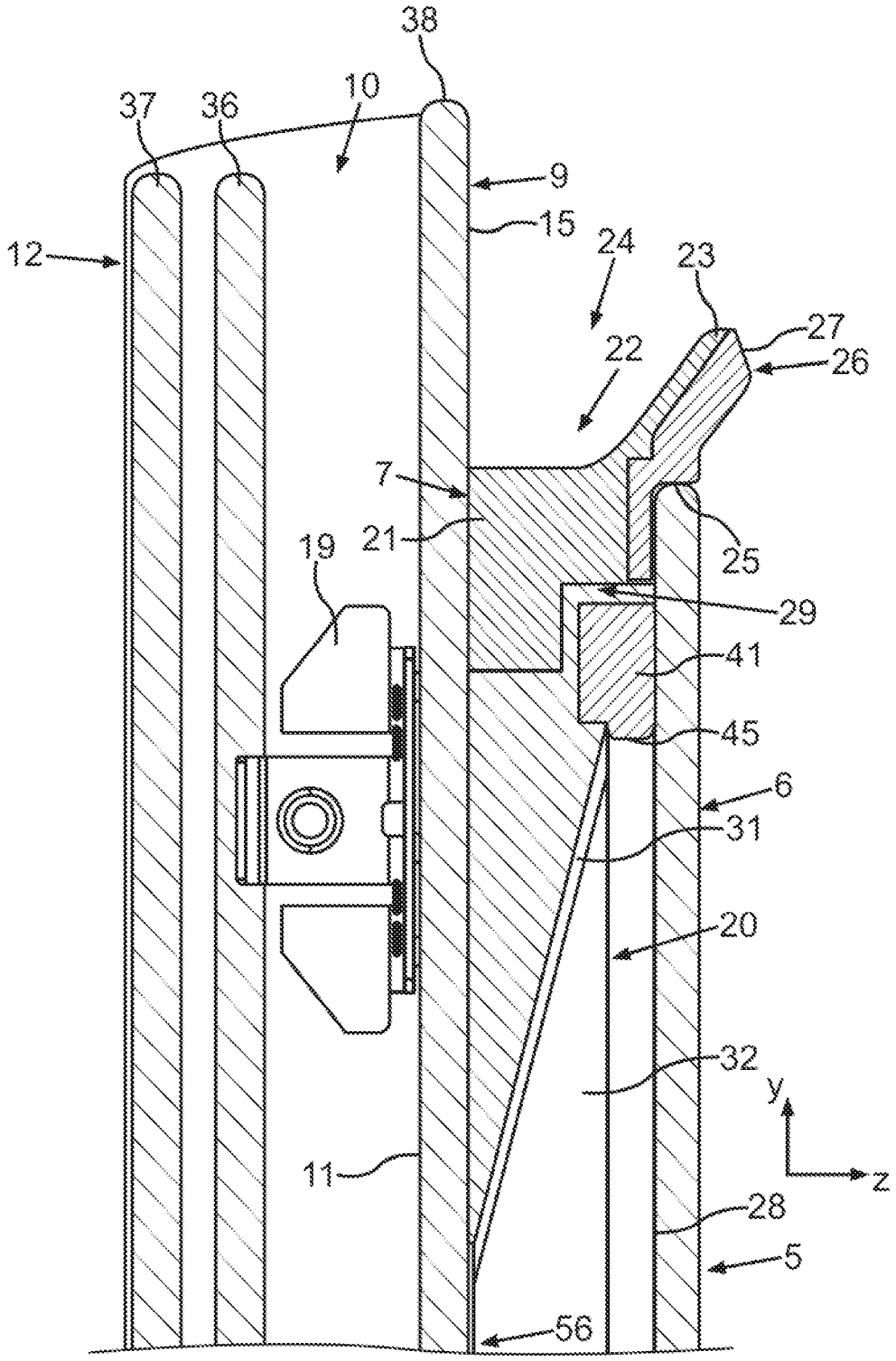
FIG. 4 shows an enlarged partial representation of the embodiment in FIG. 3.

FIG. 4 shows an enlarged representation of a partial section of the view in FIG. 4. In addition, the door profile 12 is also shown here schematically and a further pane 36 of the pane pack 10, in particular a further additional pane 37, is shown schematically here by way of example. In this context, the further pane 36 can be an intermediate pane of the pane pack 10 and the pane 37 can be an inner pane of the pane pack 10. The panes 9, 36 and 37 thus form a conventional pane pack, as can be installed in known doors. Here in FIG. 4, too, it can be seen once again that an upper edge 38 of the further pane 9 is arranged higher than the upper edge 25 of the front pane 6 when viewed in the height direction.

Figure 5:
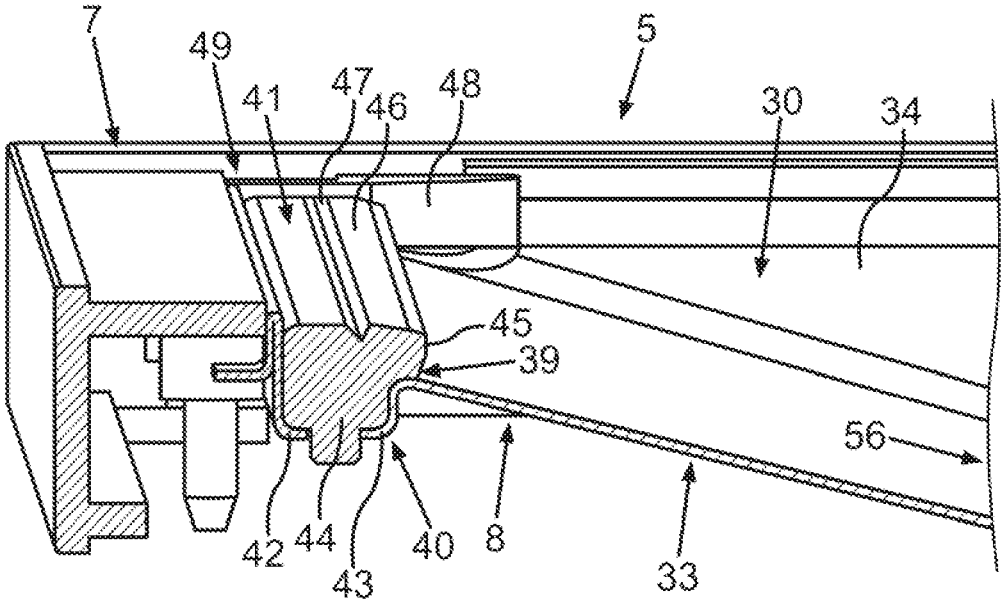
FIG. 5 shows a perspective sectional view through a further subregion of an exemplary embodiment of a door according to the invention.

FIG. 5 shows a perspective sectional representation of a subregion of an exemplary embodiment of the door 5 according to the invention. In this embodiment, the functional frame 7 and the further frame 8 connected thereto are shown. As can be seen here, a receptacle 40 for a light element 41 is embodied adjoining the funnel-shaped connecting member 30 toward the outside when viewed in the plane of the door. The channel-like receptacle 40 is embodied in one piece with the funnel-shaped connecting member 30. Here, the light element 41 is a rod-shaped light guide. It is inserted in regions into this receptacle 40. The receptacle 40 is embodied to be open toward a front pane 6 (not shown here). It can be provided that in particular a bottom 42 of this channel-like receptacle 40 has a cut-out 43, through which a coupling element 44 integrated into the light guide is inserted for holding purposes. In particular, the light guide has a bulge-shaped light radiation region 39, via which light can be radiated in a defined manner via a radiation surface 45 to the funnel-shaped connecting member 30, in particular onto the at least adjacent oblique wall 33. It can be provided that a surface 46 of the light guide facing toward the front pane 6 is polished or otherwise processed. It can also be provided here that a light emission is prevented at least partially. In particular, it can be provided that an optically effective structure 47 is embodied on this surface 46, which is here preferably a prism structure.

Figure 6:
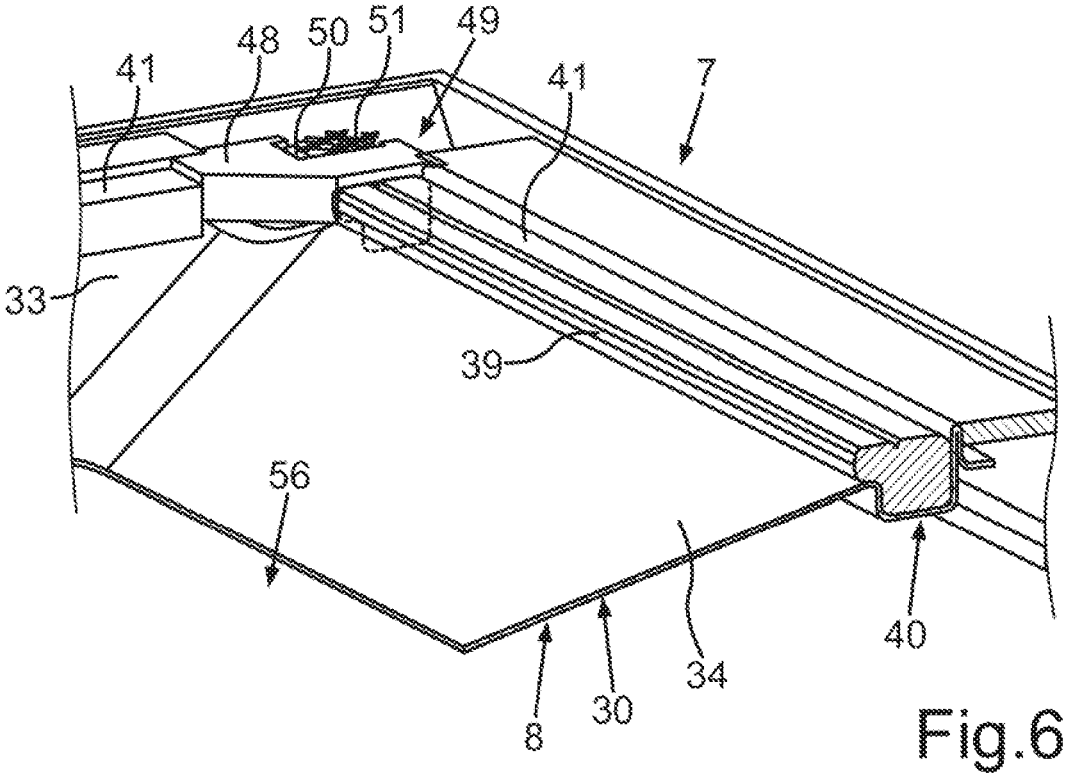
FIG. 6 shows a perspective sectional view through a further subregion of an exemplary embodiment of a door according to the invention.

Furthermore, FIG. 5 shows a receptacle which is separate from the light element or a support element 48 which is arranged in a corner region 49 of the frame 8, in particular also of the functional frame 7. This support element 48 is embodied to receive at least one light source 50, as shown in FIG. 6. At least one heat sink 51 for cooling the light source 50 can likewise be received and arranged therein.

In the representation in FIG. 6, it can also be seen that two separate, rod-shaped light elements 41 are provided in the form of light guides, which are arranged in different receptacles 40 and adjoin different ends of the support element 48. The light from the light sources 50 is preferably coupled into the light guides via these support elements 48.

Via the specific radiation regions 45 of the light elements 41 embodied as light guides, light is radiated in a targeted manner into the funnel-shaped connecting member 30, in particular onto the oblique walls 33, 34. Four light elements 41 are preferably provided, which are in each case arranged adjacent to an oblique wall 31, 32, 33 and 34. As a result, an almost circumferentially closed light guide can be embodied and light radiated particularly evenly onto the oblique walls 31 to 34.

In this way, a specific frame-like light pattern which can be perceived on the front side through the front pane 9 is created, in particular with a corresponding depth effect and a light image appearing accordingly through the funnel-shaped connecting member 30.

Figure 7:
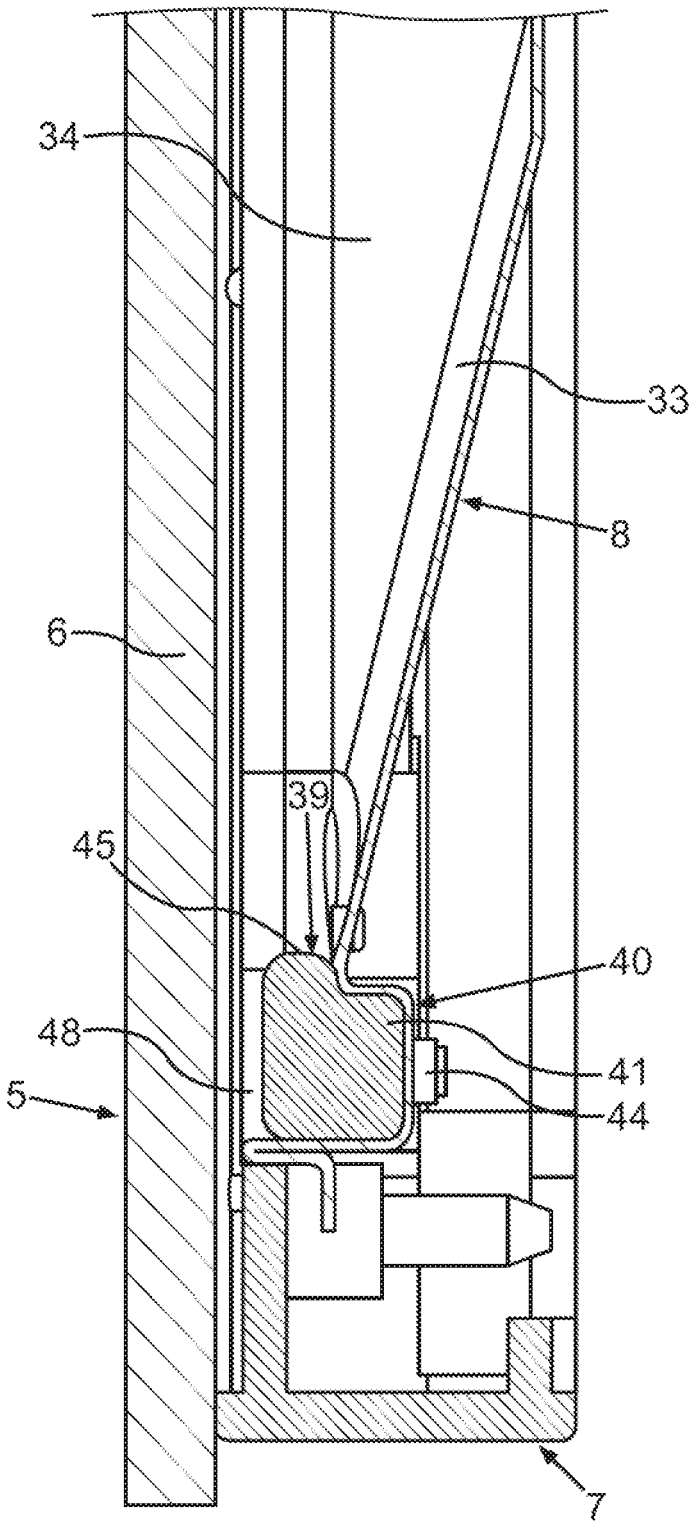
FIG. 7 shows the representation according to FIG. 5 with an additionally attached front pane and a different perspective from that shown in FIG. 5.

FIG. 7 shows a partial section of the door 5 in a sectional representation, wherein the front pane 6 is shown here in addition to the representations in FIG. 5 and FIG. 6.

Figure 8:
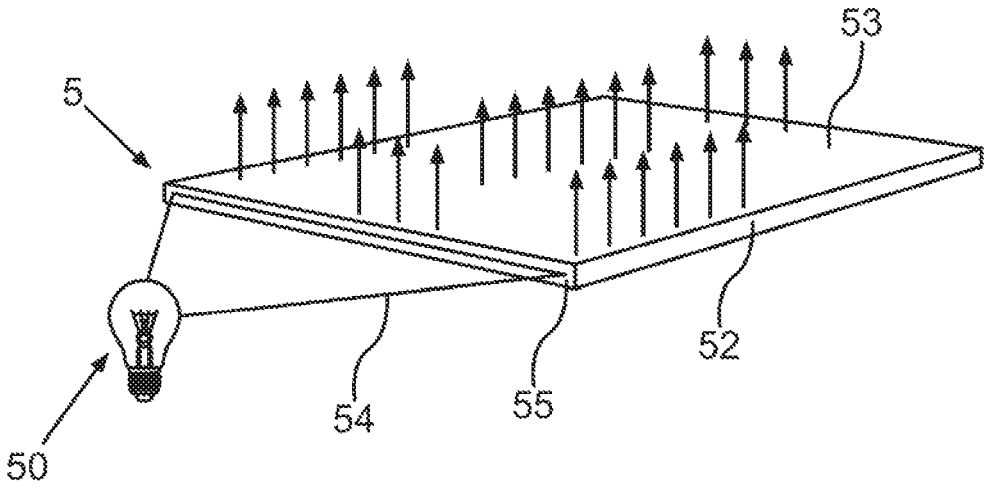
FIG. 8 shows a schematic representation of a further exemplary embodiment of subcomponents of a door for a cooking appliance.

FIG. 8 shows a further exemplary embodiment of a door 5 in a schematic representation, wherein here only subcomponents are shown. Here, too, a light source 50 is provided. The internally disposed pane 52 of the door 5 is provided with a pattern 53. This can be printed on, for example. The pattern 53 can be embodied in white and in gray tones. With the light source 50, light 54 is guided or coupled in particular into a side edge 55 of the pane 52. The light is coupled out at the points where it strikes this pattern 53 or where the pattern 53 is permeable for this light. As a result, this pane 52 is illuminated with a highly specific light pattern.

In one exemplary embodiment, this pane 52 can be the front pane 6, for example. It can also be the further pane 9.

In general, an individual lighting scenario can be created by way of the lighting device with a light element 41 and a light source 50. As a result, for example specific operating states of the cooking appliance 1 can be displayed optically. In this context, different light patterns and/or different light colors can be associated with different operating states. For example, a white illumination can be used here to indicate an activated state. In particular, it is possible for example to use a blue light color to indicate that a specific operating program is running. This operating program can be a preparation program. A further different light color, for example orange, can be used to optically indicate a pyrolysis operation of the cooking appliance.

It is also possible that, in a deactivated state of the cooking appliance, the lighting device is nevertheless operated and as a result the inactive appliance is represented with a specific ambient light in this door 5. Furthermore, in a general embodiment it is additionally provided that a type of fascia panel for components disposed therebehind, in particular of the pane pack 10, is also formed by the further frame 8 and in particular the funnel-shaped connecting member 30. Because a cut-out 56 (FIG. 2 to FIG. 6) is preferably smaller than a clear-view window of the further pane 9, it is possible here to hide components, including structural components, to a certain extent.

The invention claimed is:

1. A door for a cooking appliance, said door comprising;

a front pane;

a further pane arranged in spaced-apart relation to the front pane;

a recessed grip embodied in an upper region of the door and configured for gripping from above;

a separate functional frame arranged in an intermediate space between the front pane and the further pane when viewed in a depth direction of the door, said functional frame including an upper frame part having a delimiting web which protrudes upward on the upper frame part such that the recessed grip is embodied in the upper frame part, and a fascia panel arranged separate from the front pane on an upper edge of the front pane for covering a front side of the delimiting web at least in one region thereof.

2. The door of claim 1, wherein the delimiting web protrudes upward on a region of the upper frame part facing toward the front pane and is configured to project freely.

3. The door of claim 1, wherein the delimiting web protrudes upward with an oblique orientation facing away from the further pane such that the recessed grip widens out toward a recessed grip opening.

4. The door of claim 1, wherein the recessed grip is delimited on a rear side by a front side of the further pane.

5. The door of claim 1, wherein the fascia panel rests directly against the delimiting web.

6. The door of claim 1, wherein the further pane has an upper edge which, when viewed in a height direction of the door, is arranged higher than an upper edge of the front pane.

7. The door of claim 1, wherein the further pane has an upper edge which, when viewed in a height direction of the door, is arranged higher than an upper edge of the delimiting web.

8. The door of claim 1, further comprising a frame arranged separate from the front pane, the further pane and the separate functional frame in an intermediate space between the front pane and the further pane, said frame including a funnel-shaped connecting member.

9. The door of claim 8, wherein the funnel-shaped connecting member has oblique walls which face toward the front pane, and further comprising a light element for radiating light onto the frame such that the light is radiated onto the oblique walls of the funnel-shaped connecting member.

10. The door of claim 9, wherein the light element is a light guide.

11. The door of claim 10, wherein the light guide is rod-shaped.

12. The door of claim 9, wherein the frame includes a channel-like receptacle, said light element being arranged in the receptacle of the frame.

13. The door of claim 12, wherein the receptacle is open toward the front pane and surrounds the funnel-shaped connecting member circumferentially at least in one region thereof.

14. The door of claim 9, wherein the light element has a cross-sectionally bulge-shaped light radiation region, which is arranged facing toward the funnel-shaped connecting member.

15. The door of claim 9, wherein the light element has a side facing toward the front pane and formed with a notch as a prism structure.

16. The door of claim 8, further comprising a support element arranged separate from the frame in a corner region of the frame, and a light source received by the support element for coupling light from the light source into the light element.

17. The door of claim 16, wherein the light element rests directly on the light source.

18. The door of claim 1, wherein the further pane is a front pane of a pane pack of the door, with the front pane of the door and the functional frame being attached as a front module attachment to a front side of the front pane of the pane pack.

* * * * *